US005395023A

United States Patent [19]

Naymark et al.

[11] Patent Number: 5,395,023

[45] Date of Patent: Mar. 7, 1995

[54] MULTI-PURPOSE CARRIER FOR PORTABLE ELECTRONIC PHOTOGRAPHIC EQUIPMENT AND THE LIKE

[75] Inventors: Ronald Naymark; Janice I. Naymark, both of Saratoga, Calif.

[73] Assignee: Naymark Communications Inc., Campbell, Calif.

[21] Appl. No.: 842,773

[22] Filed: Mar. 2, 1992

Related U.S. Application Data

[63] Continuation of Ser. No. 656,690, Feb. 19, 1991, abandoned.

[51] Int. Cl.[6] ..... A45F 5/00

[52] U.S. Cl. ..... 224/253; 224/151; 224/199; 224/240; 224/245; 224/901; 383/2

[58] Field of Search ..... 224/253, 252, 224, 226, 224/228, 240, 236, 902, 901, 250, 151, 245, 242, 197, 199; 206/305, 372, 373; 455/351, 100; 190/108, 903; 383/2

[56] References Cited

U.S. PATENT DOCUMENTS

| | | | |
|---|---|---|---|
| 2,470,687 | 5/1949 | Cafrella et al. | 455/351 |
| 3,415,300 | 12/1968 | Worcester | 224/901 |
| 3,537,628 | 11/1970 | Thompson | 224/920 |
| 3,549,064 | 12/1970 | Wilson | 224/245 |
| 3,665,991 | 5/1972 | Gillemot et al. | 206/305 |
| 3,919,615 | 11/1975 | Niecke | 224/226 |
| 4,180,111 | 12/1979 | Davis | 383/2 |
| 4,424,841 | 1/1984 | Smith | 224/240 |
| 4,450,495 | 5/1984 | Naruki | 224/253 |
| 4,491,258 | 1/1985 | Jones | 224/210 |
| 4,515,300 | 5/1985 | Cohen | 224/151 |
| 4,848,624 | 7/1989 | Clem | 224/240 |
| 4,921,103 | 5/1990 | Cohen | 224/209 |
| 4,957,231 | 9/1990 | Kalisher | 224/253 |

FOREIGN PATENT DOCUMENTS

| | | | |
|---|---|---|---|
| 800936 | 12/1950 | Germany | 224/908 |

OTHER PUBLICATIONS

Case Logic, Inc. Advertisement on "Portable CD Player Case" Model DM-1-3 pages (only information available).

Tune Belt, Inc. Advertisement on "Tune Belt Radio/-Cassette Carrier"-4 pages (only information available).

*Primary Examiner*—Linda J. Sholl

*Attorney, Agent, or Firm*—Jack M. Wiseman

[57] ABSTRACT

A multi-purpose portable carrier having side-by-side compartments for the storing of portable electronic and/or photographic equipment. Successive compartments are fastened together by zipper fasteners so that the side-by-side compartments can be aligned linearly or along an arcuate path or an endless path. An intermediate compartment has a front panel that is extended away from the rear panel so as to expose the front of portable equipment stored in the intermediate compartment. The intermediate compartment has opened sides and an optionally open top. Fasteners on the inner wall of the rear panel and the rear wall of the portable equipment stored in the intermediate compartment to prevent the portable equipment from accidentally falling out of the intermediate compartment.

15 Claims, 3 Drawing Sheets fig_6
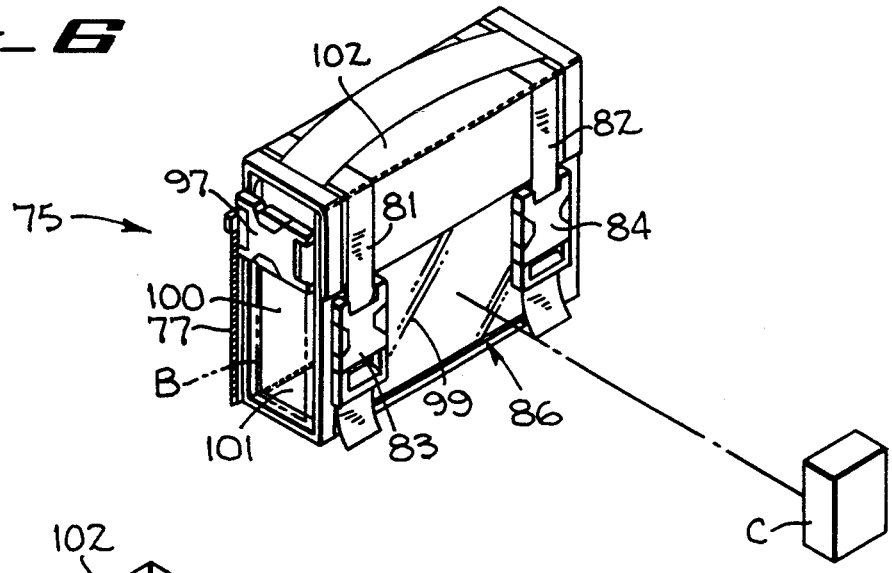
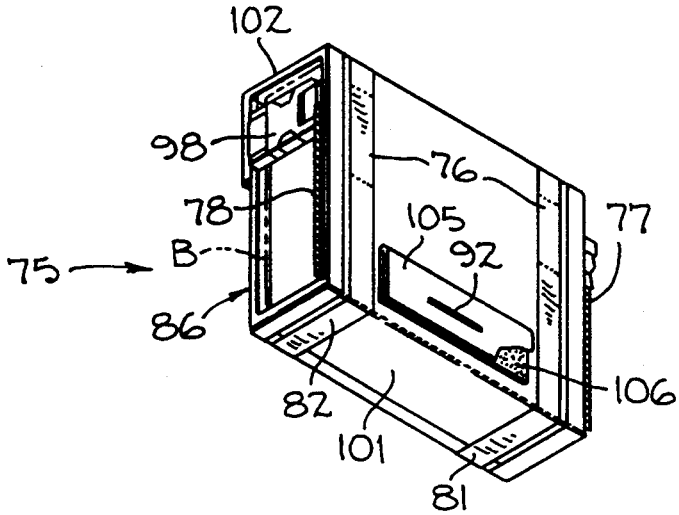
fig_7
fig_8
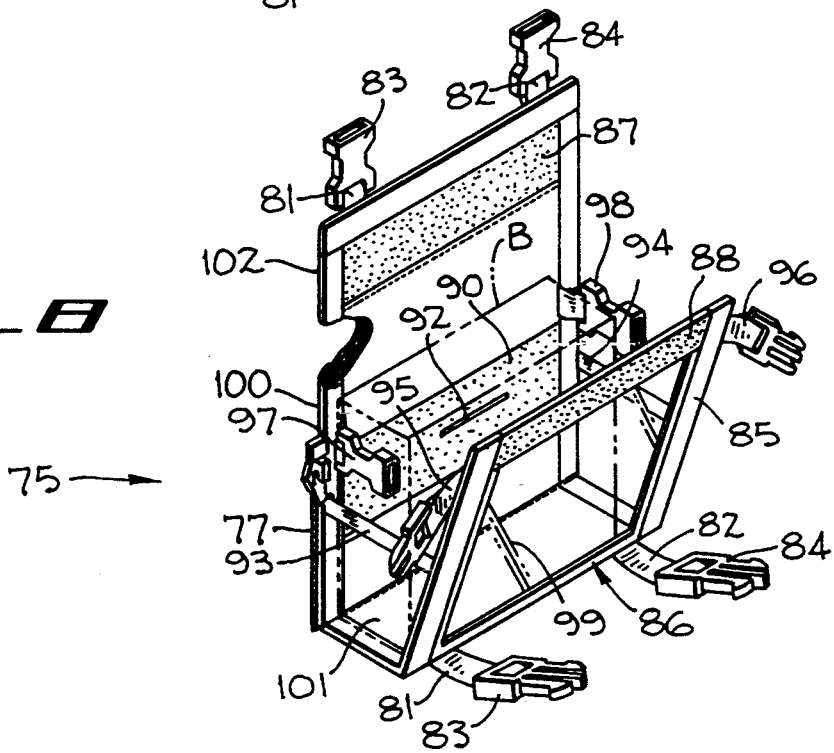

MULTI-PURPOSE CARRIER FOR PORTABLE ELECTRONIC PHOTOGRAPHIC EQUIPMENT AND THE LIKE

This is a continuation of application Ser. No. 7/656,690, filed on Feb. 19, 1991, now abandoned.

BACKGROUND OF THE INVENTION

The present invention relates in general to portable equipment carriers, and more particularly to a portable equipment carrier suitable for portable electronic equipment, portable photographic equipment, and the like.

Heretofore, portable carriers were employed with an adjustable shoulder strap and provided zippered access to headphones, discs and a compact disc player. The pockets therefor were fixedly secured back-to-back. A zippered access was provided at the bottom of one of the pockets for access to power jacks and line-out. Portable equipment carriers were also employed with an adjustable waist belt and stored a radio/cassette player along with keys and wallets.

Portable carriers for portable equipment have been found to achieve improved utility and greater functionality when provided with the following features:

a. Side-by-side separable compartments to enable the carrier to be a multi-purpose carrier;
b. Interchangeable compartments for improved flexibility of the portable equipment carried and for the comfort of the wearer;
c. Earphone conductors built in a strap with an earphone connector projecting freely from the strap;
d. Compartments with windows in the panels thereof for observing data, status and operation of the equipment stored therein;
e. Interconnecting successive side-by-side compartments to enable the side-by-side compartments to be linearly aligned, to form an arcuate path or to form an endless path for compactness; and
f. Suspension straps within a compartment to enable the front panel of the compartment to be extended to enable the front of the equipment to be accessed and chambers inside the equipment to be accessed, without removing the equipment from the compartment.

Case Logic, Inc. of Boulder, Colo., has manufactured a Model DM-1, Portable CD Player Case in which a pocket for housing discs, headphones and battery pack was fixedly secured back-to-back to a pocket for housing the compact disc player. At the bottom of the pocket containing the CD player is a zippered access for power jacks, and line-out.

Tune Belt, Inc. of Cincinnati, Ohio, has manufactured a Tune Belt radio/cassette Carrier in which a single pocket houses a radio/cassette. A headphone extends from the pocket to the ears of the wearer.

SUMMARY OF THE INVENTION

A portable carrier for portable equipment comprising detachably connected side-by-side compartments and a strap secured thereto for an operator to carry the side-by-side compartments and the portable equipment stored therein.

An object of the present invention is to provide a portable multi-purpose carrier for portable electronic, data, communication, and photographic equipment and the like.

A feature of the present invention is the provision of side-by-side separable compartments to enable the carrier to be a multi-purpose carrier.

Another feature of the present invention is the provision of earphone or headphone conductors built in a strap with a connector projecting freely from the strap.

Another feature of the present invention is the provision of respective accesses for the side-by-side compartments to conveniently hard-wire the connections between equipment respectively stored in the side-by-side compartments.

Another feature of the present invention is the provision of safety attachments within a compartment between the compartment and portable equipment to prevent the equipment from accidentally falling out of the compartment.

Another feature of the present invention is the provision of a window in the front panel of the compartment for observing control and information data on the stored equipment without removing the stored equipment from the compartment.

Another feature of the present invention is the ability to interchange compartments for improved flexibility of the portable equipment carried and for the comfort of the wearer.

Another feature of the present invention are the open-end zippers for joining successive side-by-side compartments to enable the side-by-side compartments to be linearly aligned or to form an arcuate path or to form an endless path for compactness.

Another feature of the present invention is that the carrier can be carried either by a handle on top of one or more compartments or by a shoulder strap when in an endless path configuration for compactness.

Another feature of the present invention is the provision of suspension straps to enable access to the front of the equipment and to internal chambers within the equipment and to enable a compartment front panel to be fully extended so as not to interfere with frontal or side exposure of the portable equipment stored therein.

Another object of the present invention is to provide a carrier for portable equipment that enables the portable equipment to be observed, operated, used, and/or adjusted while being carried.

Another feature of the present invention is to enable the portable equipment to be exposed while being carried for making adjustments, for ascertaining data and status, for operating the equipment and for making component parts of the equipment accessible to the operator without removal from the compartment in which it is housed.

Another feature of the present invention is to provide ventilation for the portable equipment while being used to avoid undesired temperature increases in the portable equipment.

BRIEF DESCRIPTION OF THE DRAWINGS

FIG. 6 is a front perspective view of a modification of an intermediate compartment with the cover thereof closed and diagrammatically illustrated with remotely located infrared equipment for the communication of infrared signals with infrared equipment stored therein and further illustrating the window on the front panel thereof.

FIG. 7 is a rear perspective view of the intermediate compartment shown in FIG. 6.

FIG. 8 is a front perspective view of the intermediate compartment shown in FIGS. 6 and 7 with the cover thereof opened to illustrate the suspension straps thereof for exposing the front of the portable equipment stored therein without removing the portable equipment from the intermediate compartment and with a portion thereof broken away to illustrate the construction of the material thereof.

DETAILED DESCRIPTION OF THE PREFERRED EMBODIMENTS

Figure 3:
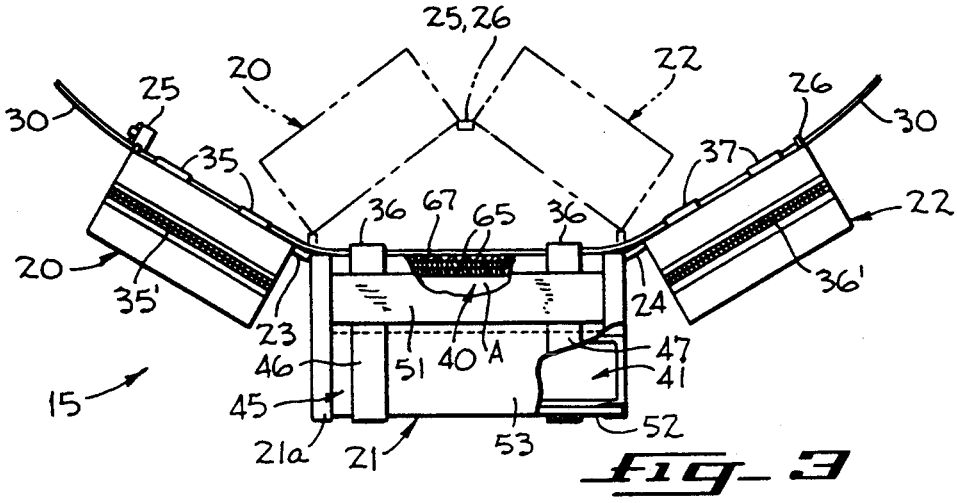
FIG. 3 is a fragmentary plan view of the multi-purpose carrier shown in FIGS. 1 and 2 with the compartments forming an arcuate path and partially broken away to illustrate the safety attachment between the intermediate compartment and the equipment stored therein.
Figure 4:
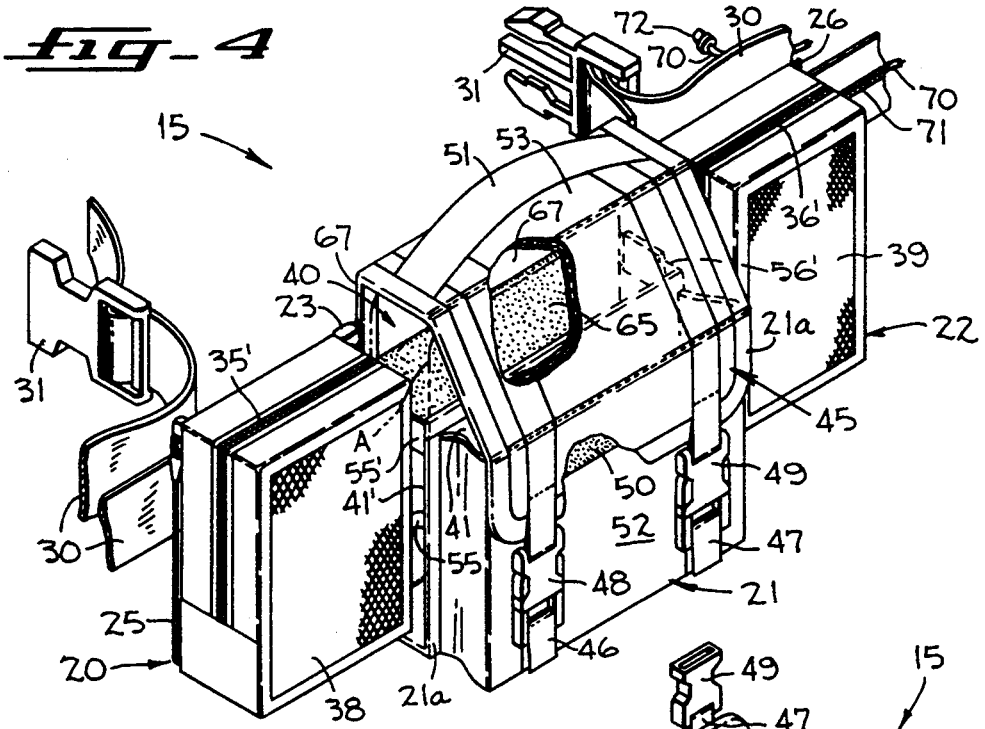
FIG. 4 is an enlarged fragmentary front perspective view of the carrier shown in FIGS. 1–3 with the cover thereof broken away to illustrate the safety attachments between the intermediate compartment and the equipment stored therein.
Figure 5:
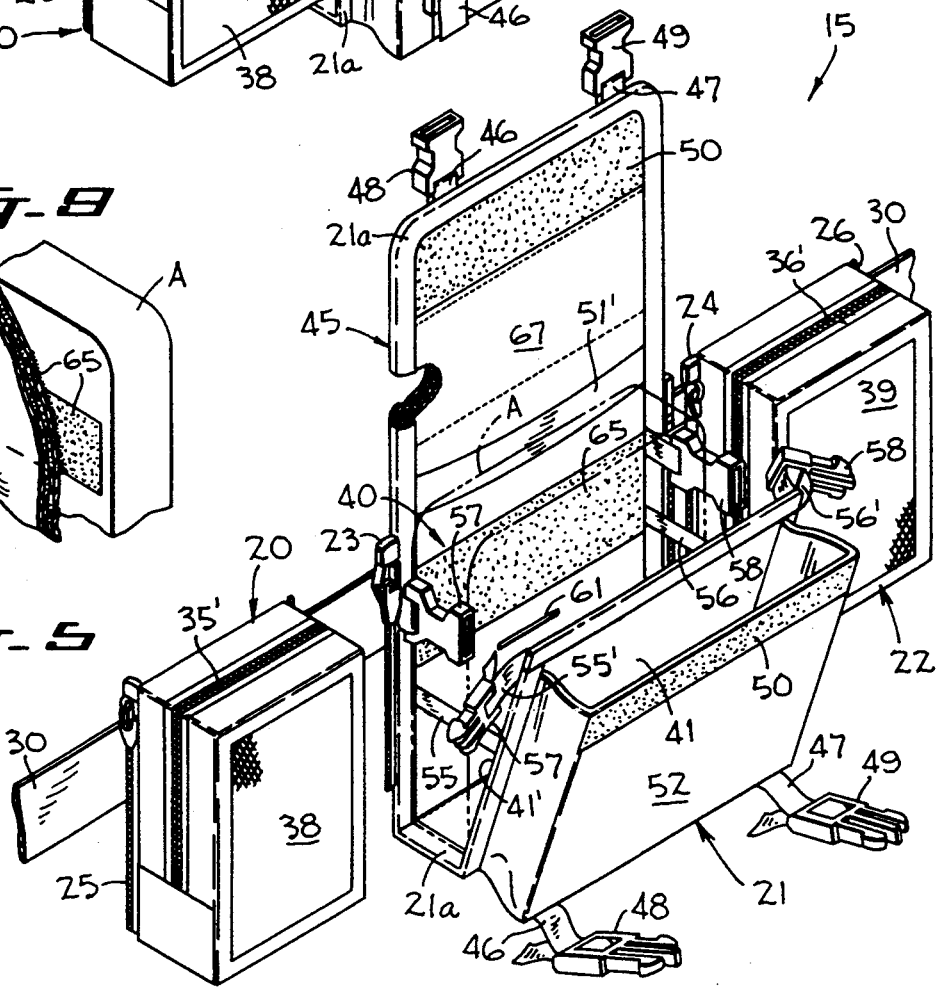
FIG. 5 is an enlarged fragmentary, exploded, front perspective view of the carrier shown in FIGS. 1–4 with the cover of the intermediate compartment thereof opened to illustrate the suspension straps thereof for exposing the front of the portable equipment stored therein without removing the portable equipment from the intermediate compartment and with a portion thereof broken away to illustrate the construction of the material from which is made the intermediate compartment.

Illustrated in FIGS. 1–5 is a multi-purpose portable equipment carrier 15 for storing and transporting portable electronic equipment, portable photographic equipment, portable data equipment, and/or portable communication equipment and the like. The carrier 15, in the preferred embodiment, comprises side-by-side compartments or pockets 20, 21 and 22. Each compartment 20–22 is adapted to store therein suitable electronic equipment, photographic equipment, portable data equipment, and/or portable communication equipment and the like. In the exemplary embodiment, the panels of the compartments 20–22 are made of padded cloth material to lessen the impact of shock on the equipment that may result from the transporting or the handling of the portable equipment. The compartments 20–22 may be made of other Suitable material such as a web material or a translucent material. In the preferred embodiment, the compartment 21, is made of a layer of closed cell foam contiguous to a layer of open cell foam. The layers of foam are interposed between or sandwiched between outer layers of a suitable cloth material (FIGS. 5 and 8). The layers of cloth and foam are bound together along the edges thereof by a ribbon 21*a* . The binding ribbon 21*a* is sewn as a unitary structure along all the edges so that there are no loose edges.

Interconnecting successive side-by-side compartments 20–22 are, in the preferred embodiment, zipper fasteners 23 and 24. In the preferred embodiment, open-ended zipper fastener components 25 and 26 are provided at the outboard sides of the compartments 20 and 22 for the attachment of additional compartments, not shown. The zipper fasteners 23 and 24 along the confronting sides of the compartments 20–22 enable the compartments 20–22, as well as additional compartments, to be linearly aligned (FIG. 1), or to be arranged in an arcuate path (FIG. 3), or to form an endless path for compactness. The compartments 20 and 22 may be disposed behind and in abutment with the intermediate carrier 21 and the free ends thereof fastened together by the zipper fastener 25 and 26 to form an endless path for compactness as shown in phantom lines in FIG. 3.

Figure 1:
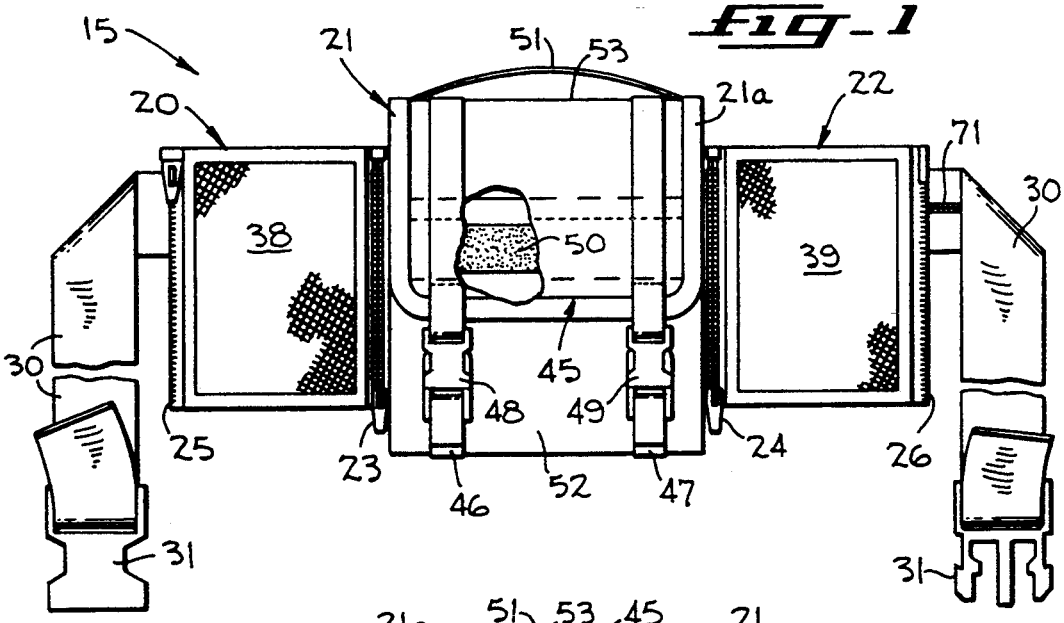
FIG. 1 is a fragmentary front elevational view of the multi-purpose carrier embodying the present invention illustrated with the compartments aligned linearly and partially broken away to illustrate a segment of a fastener below the flap of the cover of the intermediate compartment.

The portable carrier 15 includes a conventional web strap 30 with the free ends thereof adjustably secured to opposite ends of a suitable clasp or buckle 31 (FIGS. 1 and 4). In the preferred embodiment, the compartments 20–22 include suitable pairs of loops 35–37, respectively, (FIG. 2) for receiving the strap 30. The strap 30 may be employed as a belt to be secured around the waist of the wearer or it may be employed as a shoulder strap to be carried on the shoulder of the wearer.

The compartments 20 and 22 include zipper fasteners 35′ and 36′, respectively, (FIGS. 3–5) so that the compartment 20 and 22 may be individually opened and closed about the perimeter thereof along the top of the associate compartment and partially along the sides of the associate compartment for storing therein and for removing therefrom portable equipment, respectively. Additionally, the compartments 20 and 22 have front panels 38 and 39, respectively, with a suitable net or meshed material for ventilation of equipment and for the passage of sound from speakers that may be stored in the compartments 20 and 22, respectively.

The intermediate compartment 21 comprises pockets 40 and 41 secured back-to-back (FIGS. 3–5). Adapted to overlie the pockets 40 and 41 to close the compartment 21 is a flap or foldable cover 45. The flap or foldable cover 45 is stitched at the pivot line of the flap to facilitate the foldable action. Suitable straps 46 and 47 (FIGS. 1, 4 and 5) encircle the bottom side of the compartment 21, the cover 45, and a back panel 67. The straps 46 and 47 are continuous pieces and sewn to the bottom side of the compartment 21, the cover 45 and the back panel 67 leaving the portion thereof between the free end of the cover 45 and the rear edge of the bottom side of the compartment 21 free of stitches. The straps 46 and 47 also form the loops 36. Therefore, the portions of the straps 46 and 47 forming the loops 36 are not sewn to the back panel 67. Fasteners 48 and 49 secure the free ends of the straps 46 and 47, respectively. In the preferred embodiment, hook and loop fasteners, such as VELCRO fasteners 50 (FIGS. 1, 4 and 5), detachably secure the interior of the cover 45 to the exterior panel 52 of the pocket 41 of the compartment 21. Along the top panel 53 of the cover 45 is a strap 51 (FIG. 3) secured to the cover 45 to provide a hand grip for the compartment 21. An interior strap 51′ may be provided for gripping the compartment 21 when the panel 53 is pivoted as a flap concealing the strap 51.

In order to expose the front of portable electronic, photographic, data or communication equipment A (FIGS. 2 and 5) stored in the interior pocket 40 of the compartment 21, suitable extendable, resilient straps 55 and 56 are secured between the inner panel 41' of the pocket 41 and the rear panel 67 of the pocket 40 (FIG. 5). Free ends of adjustable straps 55' and 56' are detachably secured to the rear panel 67 of the compartment 21 by suitable fasteners 57 and 58. By releasing the fasteners 57 and 58, while the cover 45 is removed from the front panel 52, the pocket 41 can be extended outwardly and downwardly from the upright positions. The maximum extent of the angular movement of the pocket 41 is limited by the straps 55 and 56 for exposing the front of the portable equipment A. By so extending the pocket 41, the equipment A can be exposed while being carried for making adjustments, for ascertaining data and status, for operating the equipment, and for making component parts of the equipment accessible without removal from the compartment 21. The straps 55 and 56 are located so as not to interfere with the operation of the fasteners 57 and 58 and also to afford a greater angle of extension for the pocket 41. For increasing the exposure of the front and top of the portable equipment A, the flap of the cover 45 is extended rearwardly.

Formed in the rear panels 66–68 of each of the compartments 20–22 are suitable openings, such as slits 60–62, respectively, (FIG. 2) for the hard-wire of the equipment stored in the compartments 20–22 to electrically interconnect the equipment stored in the compartments 20–22. In the exemplary embodiment, the equipment A may be a portable radio, audio cassette player, compact disc player, camera, or the like The equipment stored in the compartments 20 and 22 may be speakers, recorders and the like not shown. The speakers and the like may be hard-wired to the player A via the slits 60–62.

To inhibit the equipment stored in the pocket 40 from accidentally falling therefrom, suitable hook and loop fasteners 65, such as VELCRO fasteners, detachably secure the interior wall of the rear panel 67 of the compartment 21 to the confronting rear wall of the equipment A (FIGS. 3, 4, 5 and 9). Although the front wall of the equipment A may be optionally fully exposed in the manner previously described, yet the equipment A will be retained in the pocket 40 through the fasteners 65. There are no side panels for the compartment 21 to facilitate the monitoring, the ventilating and the operating of equipment A in the compartment 21.

Figure 2:
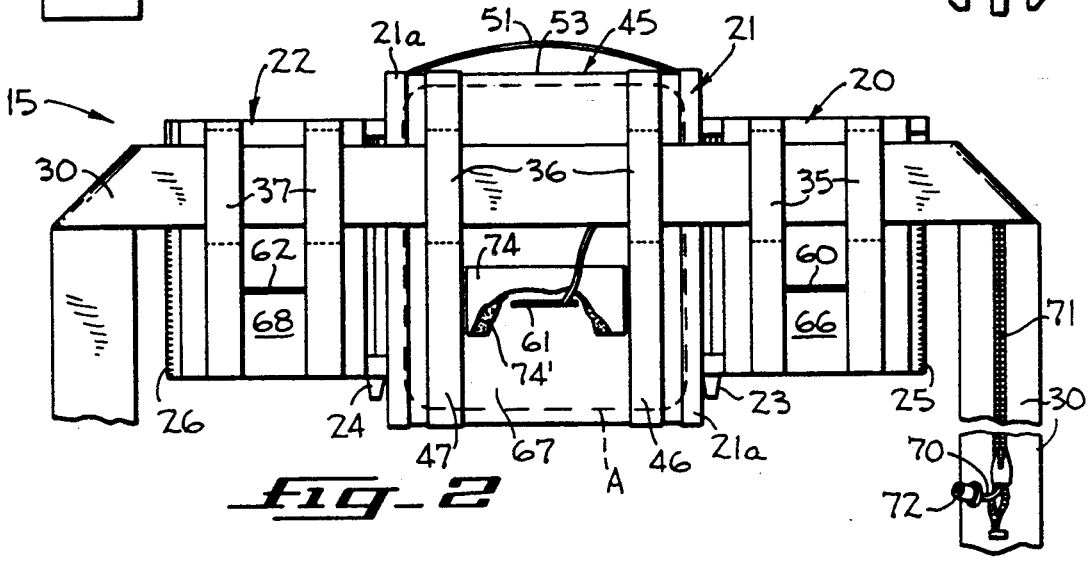
FIG. 2 is a fragmentary rear elevational view of the multi-purpose carrier shown in FIG. 1 broken away to illustrate a slot for hard-wire in the intermediate compartment.

The strap 30 carries earphone or headphone conductors 70 (FIGS. 2 and 4). An opening is formed in the strap 30 for the insertion and removal of the conductors 70. Preferably, zipper fasteners 71 are employed to open and close the opening in the strap 30. The earphone conductors 70 extend from the portable equipment A in the compartment 21 through the slit 61. At the free ends of the conductors 70 is a conventional connector 72 for suitable earphones, not shown. The connector 72 projects out of the strap 30. It is within the contemplation of the present invention that the conductors 70 can be connected directly to suitable earphones. Optionally, the wearer of the carrier 15 can use the speakers stored in the compartments 20 and 22 or the earphones connected to the connector 72. It is particularly useful to use the strap 30 for carrying the headphone conductors 70 when the strap 30 is used as a shoulder strap.

Secured to the rear panel 67 below the loops 36 is a flap 74 (FIG. 2) that is closed by means of suitable hook and loop or other suitable fasteners 74'. The flap 74 is a folded over member With one wall secured to the rear panel 67 and the folded over wall secured to the one wall by the hook and loop fasteners 74'. Excess headphone conductors 70 can be stored between the walls of the flap 74 and an earphone set can be stored between the walls of the flap 74.

Illustrated in FIGS. 6–8 is a compartment 75 which is a modification of the compartment 21. The compartment 75 comprises a pair of loops 76 to receive the strap 30. Along the side edges of the compartment 75 are oppositely directed zippered fasteners 77 and 78 so that the compartment 75 can be detachably secured in a side-by-side relation with other compartments, such as compartments 20 and 22. The compartment 75 includes a rear panel 100 that extends from a bottom panel 101 of the compartment 75 along the back of the compartment 75. A flap or foldable cover 102 extends from the rear panel 100 along the top of the compartment 75, and partially down the front of the compartment 75.

The bottom panel 101 for the compartment 75 is detachably secured to the portion of the cover 102 extending partially across the front of the compartment 75 by straps 81 and 82, and suitable fasteners 83 and 84 in a manner heretofore described in connection with the compartment 21. Additionally, the portion of the cover 102 extending across the front of the compartment 75 is detachably secured to an upper section 85 of a front panel 86 of the compartment 75. For this purpose, hook and loop fasteners, such as VELCRO straps, 87 and 88 (FIG. 8) are secured to the interior of the cover 102 extending partially across the front of the compartment 75 and on the upper section 85 of the front panel 86, respectively.

Figure 9:
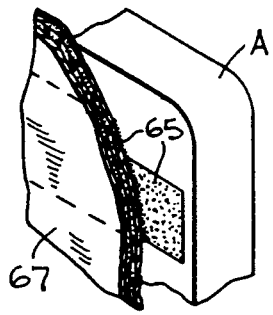
FIG. 9 is a fragmentary perspective view to illustrate the safety attachments between the intermediate compartment of the carrier shown in FIGS. 1–5 and the equipment stored therein and to illustrate the construction of the material from which is made the intermediate compartment.

To inhibit suitable equipment B from accidentally falling out of the compartment 75, the rear panel 100 of the compartment 75 on the inner rear wall thereof facing the equipment B and the rear wall of the equipment B include hook and loop fasteners, such as VELCRO straps 90, for detachably securing the equipment B to the compartment 75 (FIG. 8). FIGS. 3 and 9 provide an illustration of a similar arrangement.

Formed in the rear panel 100 is a suitable opening, such as slit 92 (FIG. 7) for the hard-wire of the equipment B stored in the compartment 75 to electrically connect the equipment B to electronic devices disposed side-by-side to the compartment 75. Should it be desired to lower the front panel 86 while the cover 102 is in the opened position, suitable resilient straps 93 and 94, detachable straps 95 and 96, and suitable fasteners 97 and 98 are provided (FIG. 8). The straps 93 and 94 limit the extent of the outward and downward movement of the front panel 86 from its initial upright position. The straps 95 and 96 and the fasteners 97 and 98 hold the front panel 86 in the upright position. Detaching the fasteners 97 and 98 enables the front panel 86 to be moved to its extended position and thereby expose and render more accessible the equipment B stored in the compartment 75. Should greater exposure be desired, the flap of the cover 102 is extended rearwardly.

A front transparent window 99 (FIGS. 6 and 8) is formed in the front panel 86 of the compartment 75 to expose the front of the equipment B. In this manner, the equipment B stored in the compartment 75 can be exposed while being carried for making adjustments, for ascertaining data and status, for operating the equipment, and for making component parts of the equipment accessible without removal from the compartment 75.

The straps 93 and 94 are located so as not to interfere with the operation of the fasteners 97 and 98 and also to afford a greater angle of extension for the front panel 86. There are no side panels for the Compartment 75 to facilitate the monitoring, ventilating and operating of the equipment B in the compartment 75. The front transparent window 99 is suitable for observing control and information data on the stored equipment B without removing the stored equipment from the compartment 75. Toward this end, the window 99 is made of suitable material, such as clear vinyl, clear plastic, glass woven nylon, polypropylene webbing, or the like.

As shown in FIG. 6, a remotely located conventional infrared equipment C communicates with conventional infrared equipment B stored in the compartment 75 or infrared equipment stored in another compartment of the carrier 15. In the exemplary embodiment, the infrared equipment B and infrared equipment C are the well-known SONY RM-DM 1K remote control kit.

Secured to the rear panel 100 below the loops 76 is a flap 105 (FIG. 7) that is closed by means of suitable hook and loop fasteners 106. The flap 105 is a folded over member with one wall secured to the rear panel 100 and the folded over wall secured to the one wall by the hook and loop fasteners 106. Excess headphone conductors can be stored between the walls of the flap 105 and an earphone can be stored between the walls of the flap 105.

The material from which the compartment 75 is made can be the same as the material heretofore described for the compartment 21. An inside strap similar to the strap 51' (FIG. 5) can be installed in the compartment 75.

What is claimed is:

1. A portable carrier for portable equipment comprising:

(a) a plurality of compartments detachably secured side-by-side for storing portable equipment therein; and (b) a waist strap secured to said compartments for an operator to carry said side-by-side compartments and the portable equipment stored therein, (c) one of said compartments comprising a rear panel having a bottom edge, a front panel having a bottom edge and extendable away from said rear panel about a lower section fold line to expose the front of portable equipment stored in said one compartment, extensible band means adjoined to said rear and front panels above the lower section fold line of the front panel for limiting the extent to which said front panel can be extended from said rear panel, and a bottom panel interconnecting in spaced relation the bottom edges of said rear panel and said front panel to provide a support base for portable equipment stored between said rear panel and said front panel of said one compartment.

2. A portable carrier as claimed in claim 1 and comprising fastening means interconnecting said rear and front panels for holding said front panel in an initial position when said fastening means are attached and for enabling said front panel to be extended when said fastening means are detached.

3. A portable carrier as claimed in claim 1 wherein said rear panel includes an inner surface, and fastener means on said inner surface of said rear panel releasably attached to portable equipment for detachably securing portable equipment stored in said one compartment to said rear panel.

4. A portable carrier as claimed in claim 1 and comprising a pocket secured to said front panel of said one compartment, said pocket being movable with said front panel in response to said front panel being extended from said rear panel.

5. A portable carrier as claimed in claim 4 wherein said one compartment comprises a cover extending from said rear panel to said front panel of said pocket, said cover including an inner wall and said front panel including an outer wall, staid one compartment including first fastener means for detachably securing said cover to said front panel of said pocket.

6. A portable carrier as claimed in claim 5 and comprising second fastener means for detachably securing said cover to said front panel of said pocket.

7. A portable carrier as claimed in claim 6 and comprising a handle attached to said cover.

8. A compartment for a portable carrier that stores portable equipment, said compartment comprising:

(a) a rear panel having a bottom edge;

(b) a front panel having a bottom edge and extendable away from said rear panel about a lower section fold line to expose the front of portable equipment stored between said rear panel and said front panel;

(c) extensible band means adjoined to said rear panel and said front panel above the lower section fold line of said front panel for limiting the extent to which said front panel can be extended from said rear panel; and (d) a bottom panel interconnecting in spaced relation the bottom edges of said rear panel and said front panel to provide a support base for portable equipment stored between said rear panel and said front panel.

9. A compartment as claimed in claim 8 wherein said rear panel includes as inner wall, and fastener means on said inner wall of said rear panel releasably attached to portable equipment for detachably securing portable equipment stored in said compartment to said rear panel.

10. A compartment as claimed in claim 9 and comprising fastening means interconnecting said rear and front panels for holding said front panel in an initial position when said fastening means are attached and for enabling said front panel to be extended when said fastening means are detached.

11. A compartment as claimed in claim 8 and comprising fastening means interconnecting said rear and front panels for holding said front panel in an initial position when said fastening means are attached and for enabling said front panel to be extended when said fastening means are detached.

12. A compartment as claimed in claim 8 wherein said rear panel includes oppositely directed sides, and detachable fastener components disposed at each of said oppositely directed sides.

13. A compartment as claimed in claim 8 and comprising a pocket secured to said front panel, said pocket being movable with said front panel in response to said front panel being extended from said panel.

14. A compartment as claimed in claims 13 wherein said pocket has a front panel and said compartment comprising a cover extending from said rear panel to said front panel of said pocket, said cover including an inner wall and said front panel of said pocket including an outer wall, and first fastener means for detachably securing said cover to said front panel of said pocket.

15. A compartment as claimed in claim 14 and comprising second fastener means for detachably securing said cover to said front panel of said pocket.

* * * * *